US005558072A

United States Patent [19]

Harima et al.

[11] Patent Number: 5,558,072

[45] Date of Patent: Sep. 24, 1996

[54] APPARATUS FOR DISPOSING OF FUEL-VAPOR

[75] Inventors: Kenji Harima, Susono; Toshinari Nagai, Sunto-gun; Hiroshi Kanai; Akinori Osanai, both of Susono; Kazuhiro Iwano, Aichi-gun; Shuji Yuda, Susono, all of Japan

[73] Assignee: Toyota Jidosha Kabushiki Kaisha, Aichi, Japan

[21] Appl. No.: 413,526

[22] Filed: Mar. 30, 1995

[30] Foreign Application Priority Data

Apr. 13, 1994 [JP] Japan ..... 6-074914

[51] Int. Cl.[6] ..... F02D 41/04; F02D 41/34

[52] U.S. Cl. ..... 123/677; 123/698

[58] Field of Search ..... 123/677, 698, 123/520

[56] References Cited

U.S. PATENT DOCUMENTS 4,926,828 5/1990 Fujimoto et al. ..... 123/677
5,072,712 12/1991 Steinbrenner et al. ..... 123/677
5,216,997 6/1993 Osanai et al. ..... 123/698
5,259,353 11/1993 Nakai et al. ..... 123/520
5,351,193 9/1994 Poirier et al. ..... 123/520

FOREIGN PATENT DOCUMENTS 58-27865 2/1983 Japan .

*Primary Examiner*—Willis R. Wolfe
*Attorney, Agent, or Firm*—Kenyon & Kenyon

[57] ABSTRACT

Fuel-vapor evaporating from a fuel tank is led though a vapor pipe and absorbed in a charcoal canister. Though the evaporating rate is influenced by the altitude where the automobile operates, the air-fuel ratio must be controlled within the proper range. This apparatus controls a purge valve in accordance with the purge rate which is determined based on the standard atmospheric pressure and compensated in accordance with the present atmospheric pressure. Therefore, this apparatus can precisely control the amount of purged fuel and the air-fuel ratio.

10 Claims, 10 Drawing Sheets

APPARATUS FOR DISPOSING OF FUEL-VAPOR

BACKGROUND OF THE INVENTION

1. Field of the Invention

The present invention relates to an apparatus for disposing of fuel-vapor, especially to an apparatus for disposing of fuel-vapor which can control the air-fuel ratio of an exhaust gas within the proper range regardless of the altitude at which an automobile having the apparatus operates.

2. Description of the Related Arts

Fuel-vapor evaporating from a fuel tank is absorbed in a charcoal canister, and is properly purged in an inlet pipe as fuel in order to improve fuel consumption and to avoid air pollution.

Because atmospheric pressure decreases when the automobile runs at a high altitude, the evaporation of fuel stored in a fuel tank increases. As the amount of the fuel-vapor absorbed in a charcoal canister increases, it is necessary to prolong the purge period. However, because a throttle valve must be made more open at a high altitude than at a low altitude, the purge period and the total purge amount decreases.

To solve the above-mentioned problem, a purge control apparatus which increases the opening of the purge valve in order to compensate for a decrease in atmospheric pressure by using an altitude compensating valve has been proposed (see Unexamined Patent Publication (Kokai) No. 58-27865).

It is, therefore, necessary to purge as often as possible so far as the fuel-vapor purged from the charcoal canister does not disturb the air-fuel ratio control, because the large amount of fuel-vapor exerts a harmful influence upon the air-fuel ratio control. The above-mentioned purge control apparatus does not take account of this effect.

Therefore, a deterioration in drivability or of exhaust gas emissions due to the disturbance of the air-fuel ratio control produced by the purge control cannot be avoided.

SUMMARY OF THE INVENTION

It is an object of the present invention to provide an apparatus for disposing of fuel-vapor which can operate when the automobile operates at a high altitude, and can avoid a harmful influence upon the air-fuel ratio control.

According to one aspect of the present invention, the standard opening of the purge valve or the correction factor for the basic fuel amount is corrected for atmospheric pressure in order to maintain the balance between the real purge rate and the correction factor for the fuel amount determined by the target purge rate because the real purge rate when the opening of the purge valve is set to the standard opening of the purge valve at the standard atmospheric pressure and the target purge rate determined in accordance with the driving condition of the engine varies in accordance with the atmospheric pressure.

According to another aspect of the present invention, the opening of the purge valve is determined after correcting the fully open purge rate at the standard atmospheric pressure in accordance with an atmospheric pressure.

According to another aspect of the present invention, the opening of the purge valve is determined after determining the fully open purge rate based on the two fully open purge rates at two different specific atmospheric pressures and the operating atmospheric pressure.

According to another aspect of the present invention, the opening of the purge valve is determined by the corrected target purge rate, that is, the target purge rate corrected for the operating atmospheric pressure.

BRIEF DESCRIPTION OF THE DRAWINGS

The present invention will be more clearly understood from the description as set forth below with reference to accompanying drawings, wherein.

DESCRIPTION OF THE PREFERRED EMBODIMENT

Figure 1:
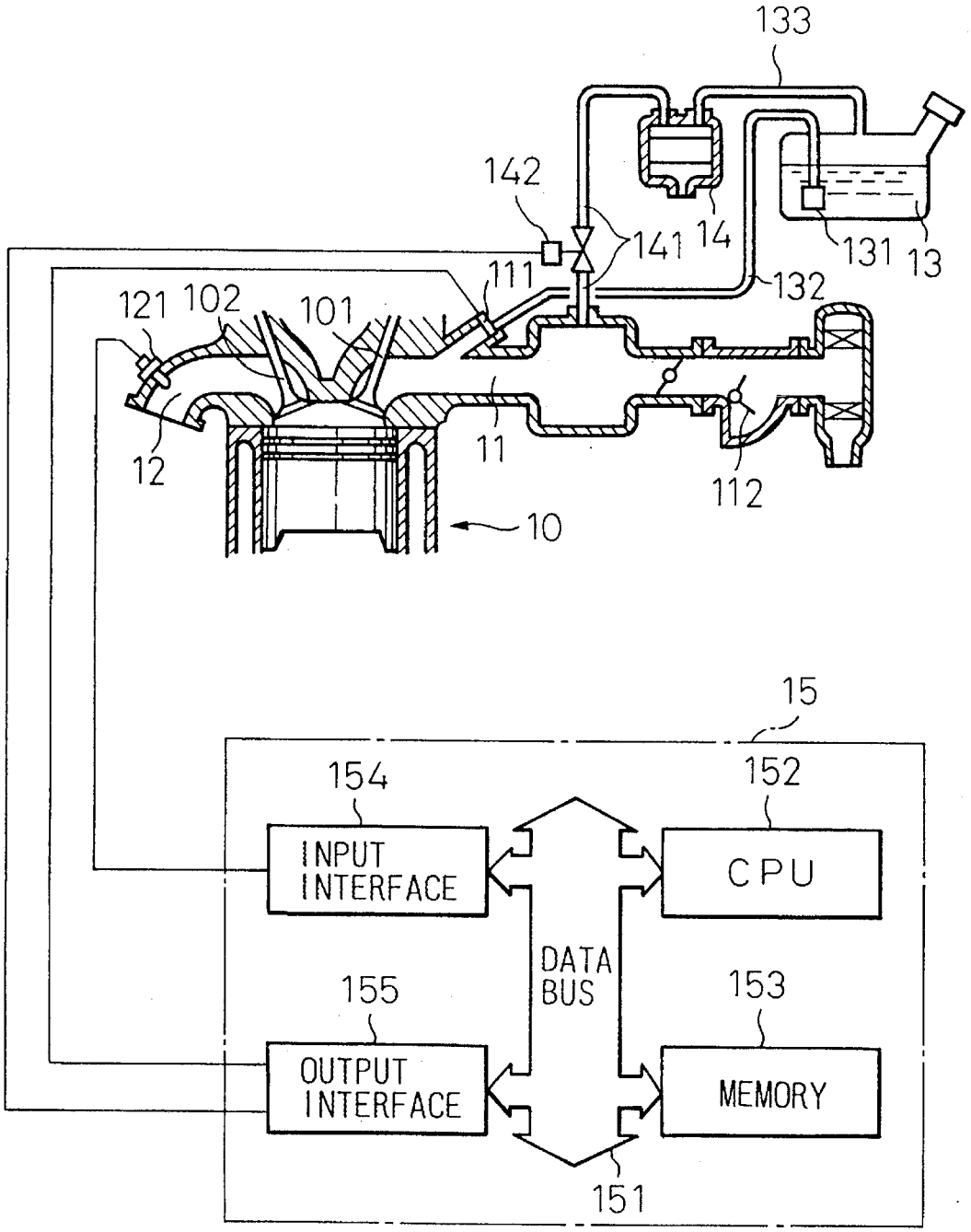
FIG. 1 is a schematic diagram of an apparatus for disposing of fuel-vapor according to the present invention.

FIG. 1 is a schematic diagram of the apparatus for disposing of fuel-vapor according to the present invention in which one cylinder 10 of the engine is connected to an inlet pipe 11 through an inlet valve 101, and to an exhaust pipe 12 through an exhaust valve 102.

A fuel injection valve 111 is arranged, adjacent to the inlet valve, on the inlet pipe 11.

An air-flow meter 112 which detects air-flow is arranged at the upstream end of the inlet pipe.

Fuel stored in a fuel tank 13, and pressurized by a fuel pump 131 is supplied to the fuel injection valve 111 through a fuel pipe 132.

Fuel-vapor evaporating from the fuel tank 13 is led to a charcoal canister 14 through a vapor pipe 133.

The charcoal canister 14 is connected to the inlet pipe 11 by the purge pipe 141, and the purge valve 142 is installed on the purge pipe 141.

An air-fuel ratio sensor 121 which detects the air-fuel ratio of the exhaust gas is installed on the exhaust pipe 12.

The apparatus for disposing of fuel-vapor is controlled by the control system 15, and the control system is constructed as a microcomputer system.

That is, the control system 15 has a data-bus 151, a CPU 152, a memory 153, an input interface 154 and an output interface 155.

The air-fuel ratio sensor 121 and the air-flow meter 112 are connected to the input interface 154. The air-fuel ratio and the air-flow are fetched by the control system.

The control system 15 controls the fuel injection valve 111 and the purge control valve 142 through the output interface 155.

According to the apparatus for disposing of fuel-vapor, the fuel-vapor evaporated from the fuel tank 13 is absorbed in the charcoal canister 14.

Because the pressure in the inlet pipe 11 is negative, fuel-vapor absorbed in the charcoal canister 14 is supplied to the inlet pipe 11 through the purge pipe 141 when the purge control valve 142 is opened, and is used as fuel after being mixed with the fuel injected by the fuel injection valve 111.

On the other hand, the air-fuel ratio of the exhaust gas is detected by the air-fuel ratio sensor 121, and is used to determine the opening period of fuel injection valve 111 by the control system 15.

Figure 2:
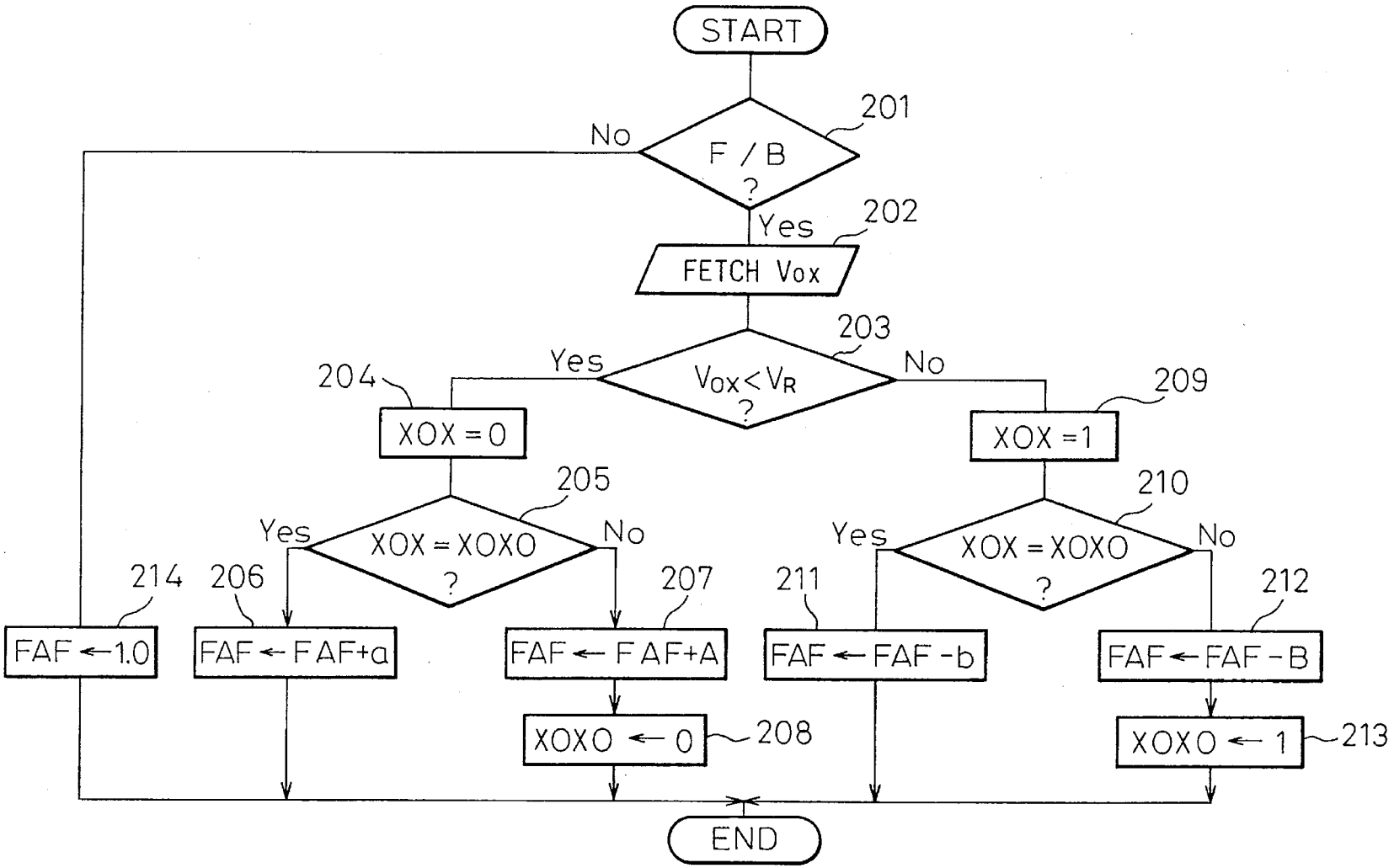
FIG. 2 is a flowchart of the air-fuel ratio control routine.

FIG. 2 is the flowchart of the air-fuel control routine executed in the apparatus for disposing of fuel-vapor according to the present invention, and this routine is executed at every the predetermined cam angle.

At step 201, it is determined whether or not the air-fuel control is allowable.

Namely, (1) The engine is not being started.

(2) The fuel is not being cut.

(3) The coolant temperature (THW) ≧40° C.

(4) The air-fuel ratio sensor has been activated.

When all the above-mentioned conditions are satisfied, the air-fuel ratio feedback control is allowed. However, if any one of the above-mentioned conditions is not satisfied, it is not allowed.

If the determination at step 201 is affirmative, the control proceeds to step 202, where the output voltage $V_{ox}$ of the air-fuel ratio sensor 121 is fetched. At step 203, it is determined whether or not the output voltage $V_{ox}$ is lower than the predetermined reference voltage $V_R$ (for example, 0.45 V).

If the determination at step 203 is affirmative, that is, if the air-fuel ratio of the exhaust gas is lean, the control proceeds to step 204, where the air-fuel ratio flag XOX is set to "0".

At step 205, it is determined whether or not the air-fuel ratio flag XOX is identical with the status keeping flag XOXO.

If the determination at step 205 is affirmative, that is, if the lean state is continuing, the control proceeds to step 206, where the air-fuel ratio correction factor FAF increases the lean integral constant "a", and this routine is terminated.

If the determination at step 205 is negative, that is, if the air-fuel ratio changes from the rich state to the lean state, the control proceeds to step 207, where the air-fuel ratio correction coefficient FAF increases the lean skip constant "A".

Note, the lean skip constant "A" is set to a much larger value than the lean integral constant "a".

At step 208, the status keeping flag XOXO is reset, and this routine is terminated.

If the determination at step 203 is negative, that is, if the air-fuel ratio of the exhaust gas is rich, the control proceeds to 209, where the air-fuel ratio flag XOX is set to "1".

At step 210, it is determined whether or not the air-fuel ratio flag XOX is identical with the status keeping flag XOXO.

If the determination at step 210 is affirmative, that is, if the rich state is continuing, the control proceeds to step 211, where the air-fuel ratio correction factor FAF decreases the rich integral constant "b", and this routine is terminated.

If the determination at step 210 is negative, that is, the air-fuel ratio changes from the lean state to the rich state, the control proceeds to step 212, where the air-fuel ratio correction factor FAF decreases the rich skip constant "B".

Note, the rich skip constant "B" is set to a much larger value than the rich integral constant "b".

At step 213, the status keeping flag XOXO is set to "1", and this routine is terminated.

Note, when the determination at step 201 is negative, the control proceeds to step 214, where the air-fuel ratio correction factor FAF is set to "1.0", and this routine is terminated.

Figure 3:
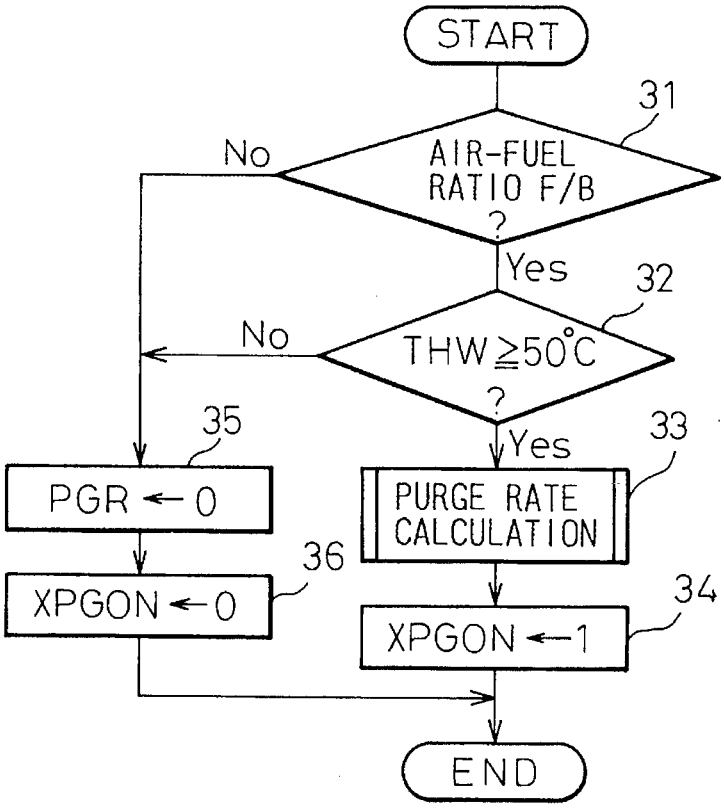
FIG. 3 is a flowchart of the purge rate control routine.

FIG. 3 is the flowchart of the purge rate control routine to determine a target purge rate at standard atmospheric pressure, and it is determined whether or not the air-fuel ratio feedback control is allowed at step 31.

If the determination at step 31 is affirmative, the control proceeds to step 32, where it is determined whether or not the coolant temperature THW is higher than 50° C.

If the determination at step 32 is affirmative, the control proceeds to step 33, where the purge rate calculation is executed, and this routine is terminated after the purge executing flag XPGON is set to "1" at step 34.

If the determination at step 31 or 32 is negative, the control proceeds to step 35, where the purge rate PGR is reset, and this routine is terminated after the purge executing flag XPGON is reset at step 36.

Figure 4:
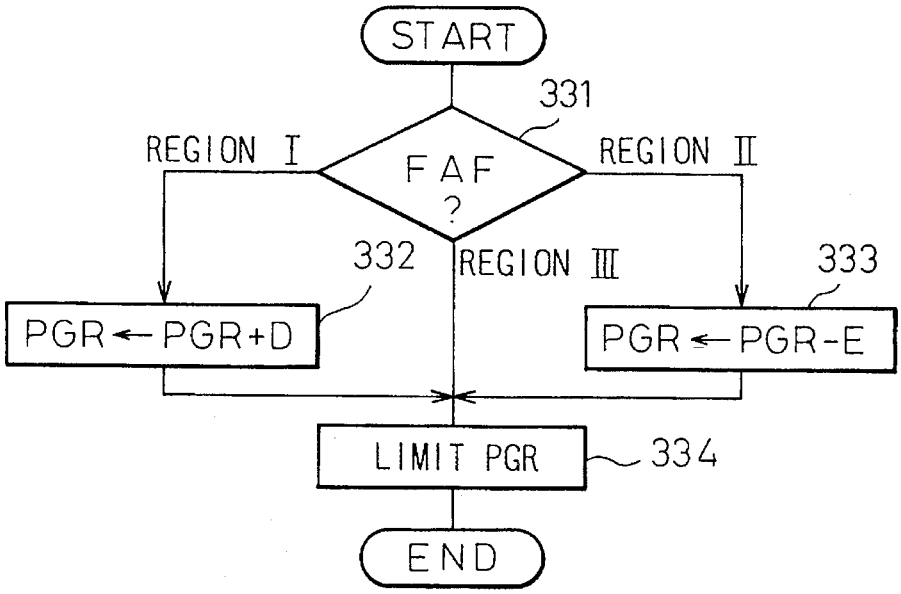
FIG. 4 is a flowchart of the purge rate calculating routine.

FIG. 4 is the, flowchart of the purge rate calculating routine executed at step 33, and it is determined to which region the air-fuel ratio correction factor FAF belongs at step 331.

Figure 5:
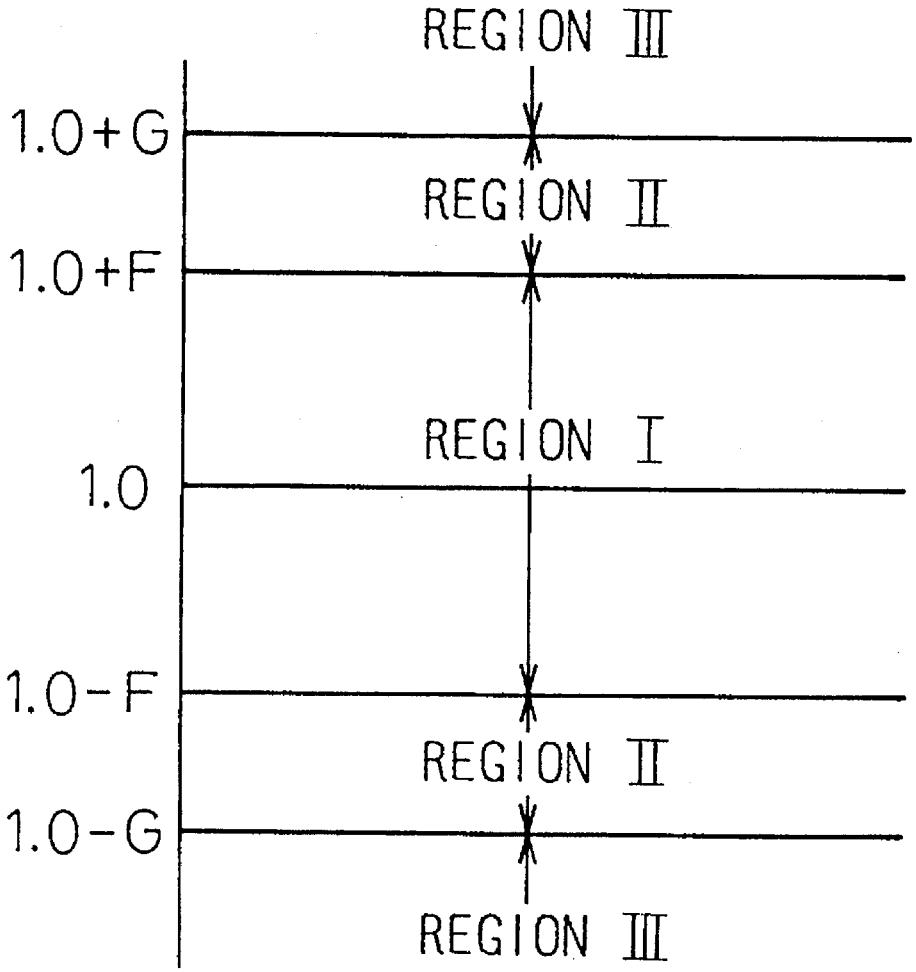
FIG. 5 is a diagram for showing the domain of the air-fuel ratio correction factor.

FIG. 5 is the graph showing the regions of the air-fuel ratio correction factor, and it is determined that the air fuel correction factor belongs in the region "I" if it is within 1±F, it belongs in the region "II" if it is between 1±F and 1±G, and it belongs in the region "III" if it is outside 1±G. Note, 0<F<G.

If the determination at step 331 is that the air-fuel correction factor belongs to the region "I", the control proceeds to step 332, where the purge rate PGR increases the purge increasing amount D, and the control proceeds to step 334.

If the determination at step 331 is that the air-fuel correction factor belongs to the region "III", the control proceeds to step 333, where the purge rate PGR decreases the purge decreasing amount E, and the control proceeds to step 334.

If the determination at step 331 is that the air-fuel correction factor belongs to the region "II", the control directly proceeds to step 334.

At step 334, the purge rate PGR is limited to the low limit and the upper limit, and this routine is terminated.

Figure 6:
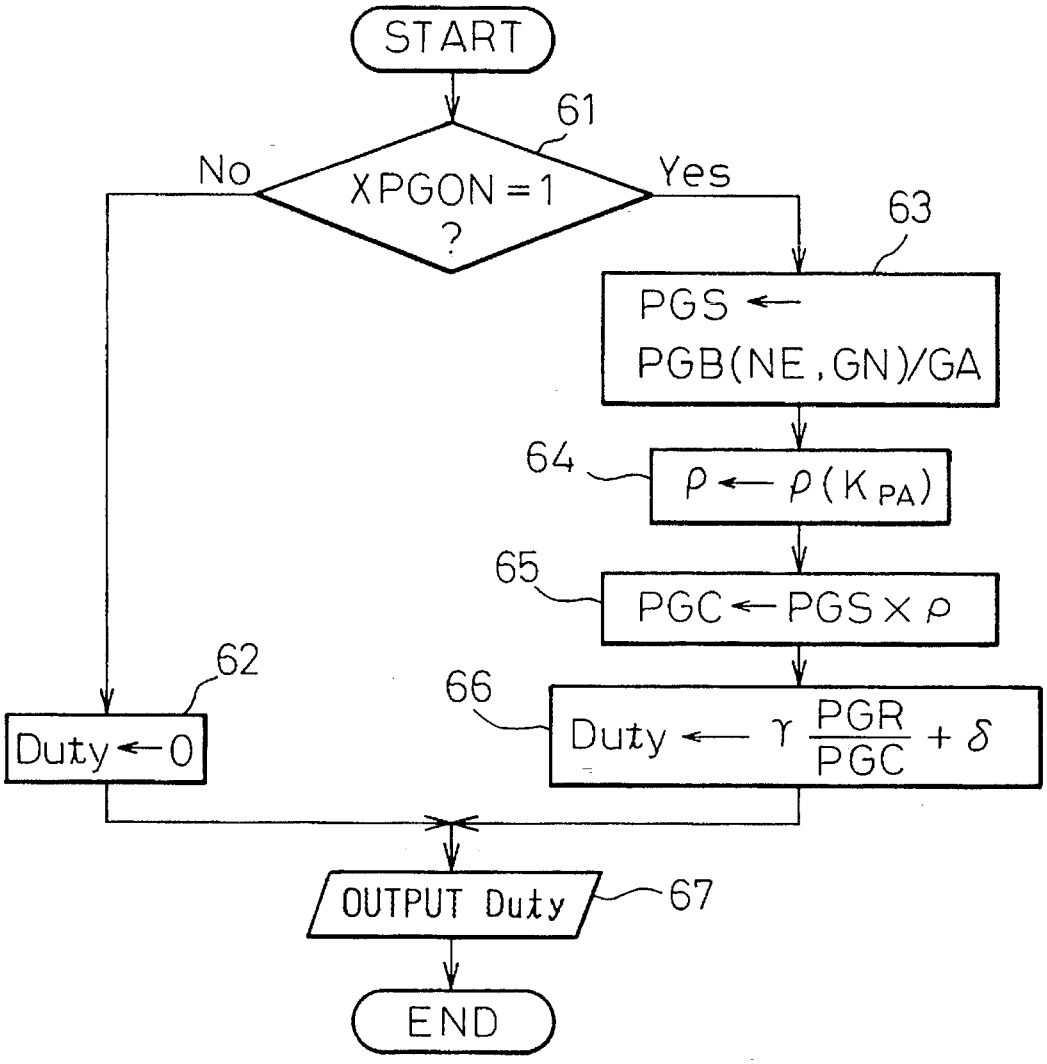
FIG. 6 is a flowchart of the first purge valve control routine.

FIG. 6 is the flowchart of the first purge-valve control routine used in the first invention, and it is determined that the purge executing flag XPGON is "1" at step 61.

If the determination at step 61 is negative, the control proceeds to step 62, where the duty ratio Duty is reset, and the control then proceeds to step 67.

If the determination at step 61 is affirmative, the control proceeds to step 63, where the standard fully open purge rate PGS, that is, the purge rate when the purge-valve is fully opened at the standard atmospheric pressure, is calculated.

Namely, the standard fully open purge flow rate PGB is calculated as the function of the engine revolutions NE and the inlet-air flow per revolution GN, and the standard full open purge rate PGS is determined by dividing PGB by the present inlet-air flow rate GA.

$$PGS=PGB(NE,GN)/GA$$

Figure 7:
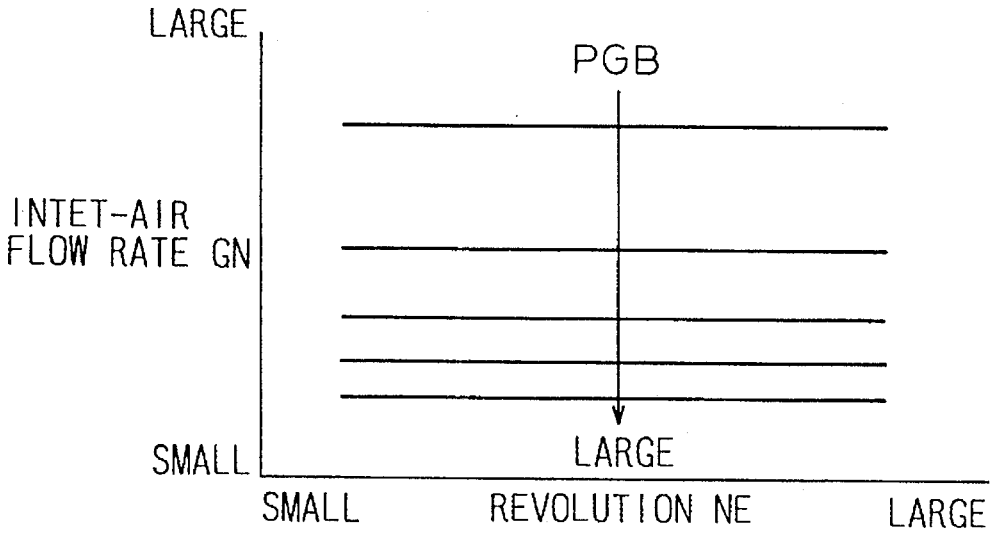
FIG. 7 is a diagram to determine the standard fully open purge flow.

FIG. 7 is the graph to determine the standard full open purge flow rate PGB (the flow rate per unit time), in which the abscissa shows the engine revolution NE and the ordinate shows the inlet-air flow rate per revolution GN.

Because the fully open purge flow rate is a function of the inlet air pressure, the larger the inlet-air flow per revolution GN, the smaller the standard fully open purge flow rate PGB is set, regardless of the engine revolution NE.

At step 64, the first pressure correction factor ρ is calculated as a function of the pressure ratio $K_{pa}$ which is the ratio of the atmospheric pressure where the automobile is operating to the standard atmospheric pressure (760 mmHg).

$$\rho=\rho(K_{pa})$$

Figure 8:
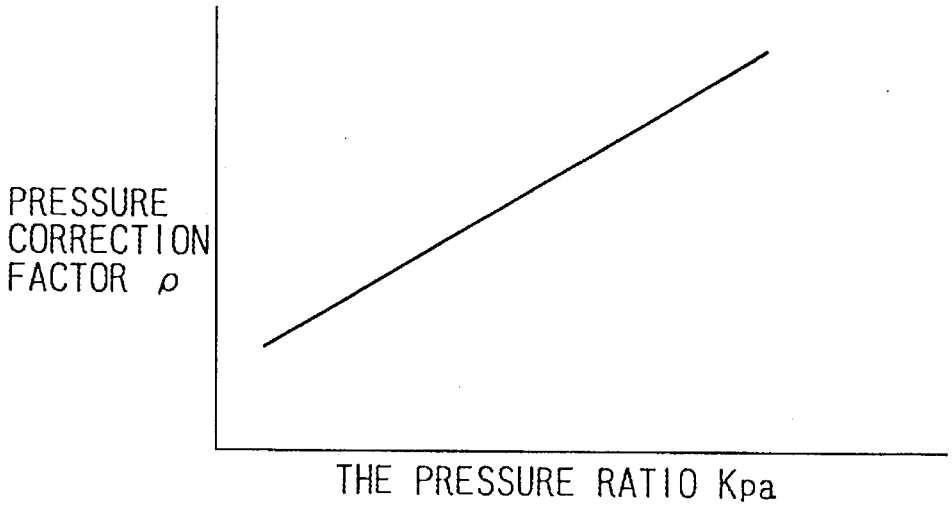
FIG. 8 is a graph to determine the atmospheric pressure correction factor.

FIG. 8 is the graph to determine the first pressure correction factor ρ, and the abscissa shows the pressure ratio $K_{pa}$, and the ordinate shows the first pressure correction factor ρ. The first pressure correction factor ρ is determined as the value which is proportional to the pressure ratio $K_{pa}$.

At step 65, the corrected full open purge rate PGC is calculated by multiplying the standard full open purge rate PGS and the first pressure correction factor ρ.

At step 66, the duty ratio Duty is calculated from the following equation, and the control proceeds to step 67.

$$\text{Duty}=\gamma\cdot PGR/PGC+\delta$$

Where γ and δ are the correction coefficients according to the battery voltage and the atmospheric pressure respectively.

At step 67, the duty ratio Duty is output, and this routine is terminated.

According to the first embodiment of the present invention, the opening of the purge valve is determined after correcting the fully open purge rate at the standard atmospheric pressure in accordance with an atmospheric pressure where the automobile is operating.

Figure 9:
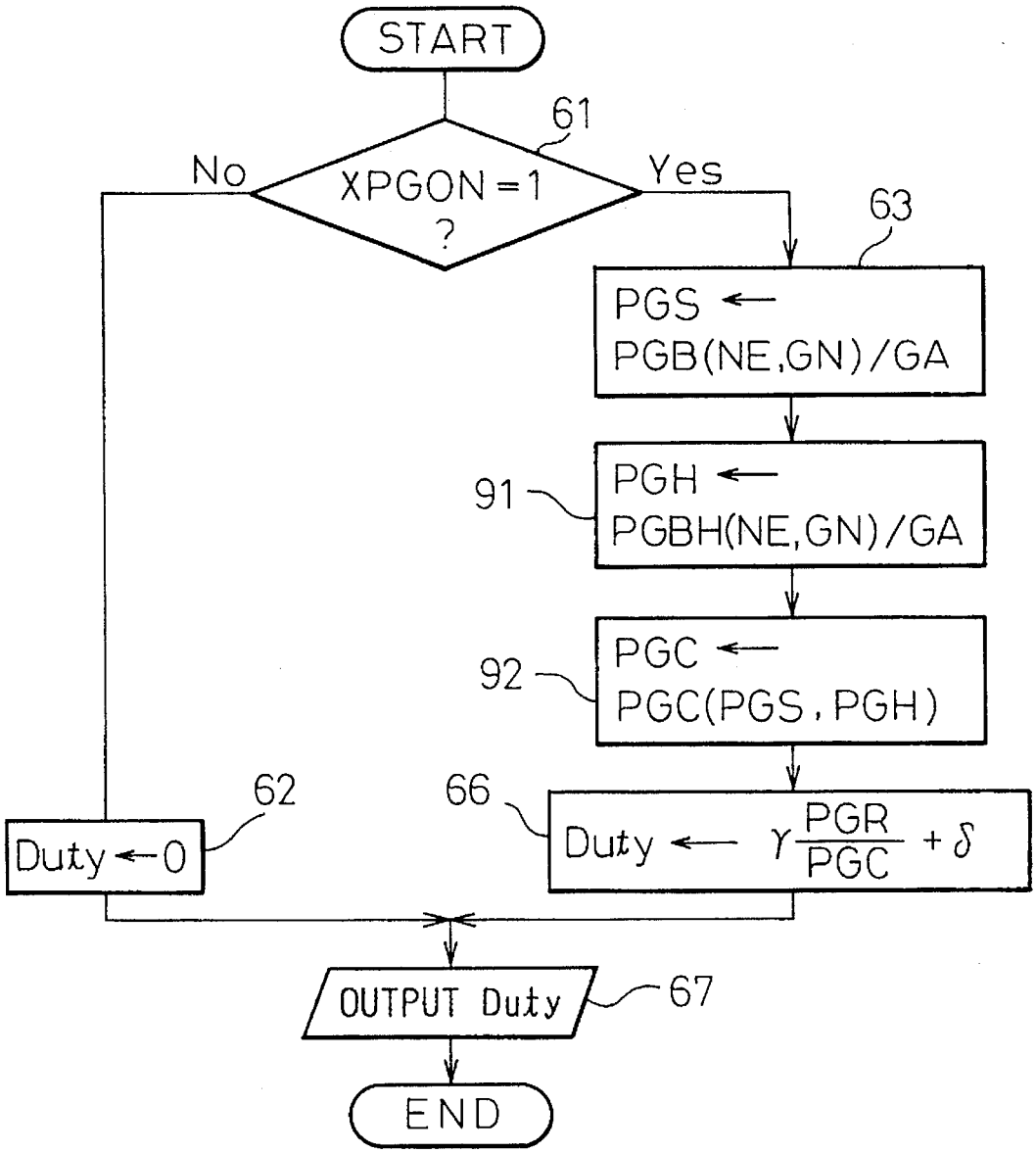
FIG. 9 is a flowchart of the second purge valve control routine.

FIG. 9 is the second purge-valve control routine used in the second invention, and the same step numbers are used for the steps where the same process as the first purge-valve control routine are executed.

At step 61, it is determined that the purge executing flag XPGON is "1".

If the determination at step 61 is negative, the control proceeds to step 62, where the duty ratio Duty is reset, and the control proceeds to step 67.

If the determination at step 61 is affirmative, the control proceeds to step 63, where the standard fully open purge rate PGS is calculated from the following equation.

Namely, the standard fully open purge flow rate PGB is calculated as the function of the engine revolution NE and the inlet-air flow per revolution GN, and the standard fully open purge rate PGS is determined by dividing PGB by the present inlet-air flow rate GA.

$$PGS=PGB(NE,GN)/GA$$

At step 91, the specific fully open purge rate PGH, that is, the purge rate when the purge-valve is fully opened at the predetermined specific atmospheric pressure (for example, 500 mmHg) is calculated from the following equation.

Namely, the specific fully open purge flow rate PGBH is calculated as the function of the engine revolution NE and the inlet-air flow per revolution GN, and the specific fully open purge rate PGH is determined by dividing PGBH by the present inlet-air flow rate GA.

$$PGH=PGBH(NE,GN)/GA$$

At step 92, the operating fully open purge rate PGC is calculated as the function of the standard fully open purge rate PGS and the specific fully open purge rate PGH.

Note, it is proper to use the following interpolation equation as the function.

$$PGC=(PGS-PGH)\cdot(\rho-\rho_{min})/(\rho_{max}-\rho_{min})+PGH$$

Where $\rho_{min}$ is the ratio of the atmospheric pressure at the high ground (for example, 500 mmHg) to the standard atmospheric pressure (760 mmHg), and $\rho_{max}$ is "1.0".

At step 66, the duty ratio Duty is calculated from the following equations, and the control proceeds to step 67.

$$\text{Duty}=\gamma\cdot PGR/PGC+\delta$$

Where γ and δ are the correction coefficients according to the battery voltage and the atmospheric pressure respectively.

At step 67, the duty ratio Duty is output, and this routine is terminated.

According to the second embodiment of the present invention, the opening of the purge valve is determined after determining the fully open purge rate based on the two fully open purge rates at two different specific atmospheric pressures and the atmospheric pressure where the automobile is operating.

Figure 10:
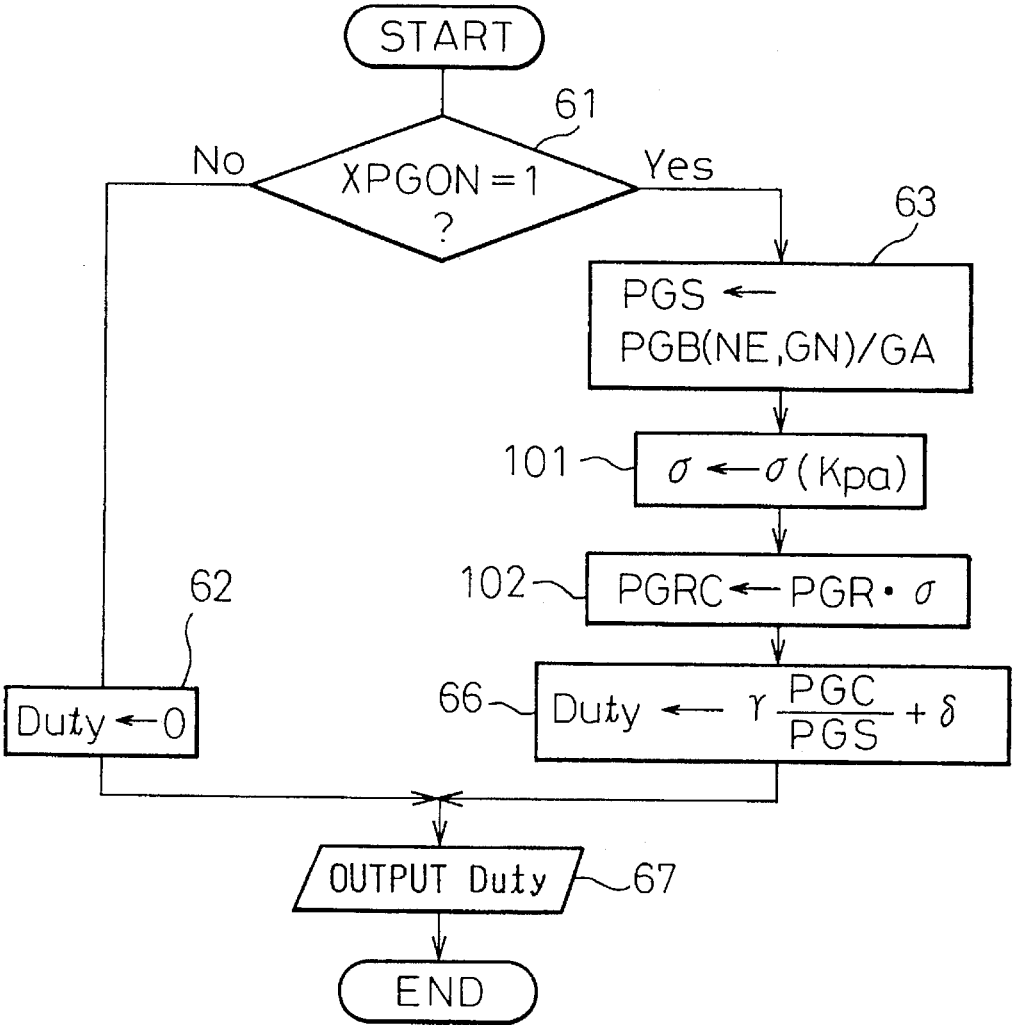
FIG. 10 is a flowchart of the third purge valve control routine.

FIG. 10 is the third purge-valve control routine used in the third invention, and the same step numbers are used for the steps where the same process as the first purge-valve control routine is executed.

At step 61, it is determined that the purge executing flag XPGON is "1".

If the determination at step 61 is negative, the control proceeds to step 62, where the duty ratio Duty is reset, and the control proceeds to step 67.

If the determination at step 61 is affirmative, the control proceeds to step 63, where the standard full open purge rate PGS is calculated from the following equation.

Namely, the standard full open purge flow rate PGB is calculated as the function of the engine revolution NE and the inlet-air flow per revolution GN, and the standard full open purge rate PGS is determined by dividing PGB by the present inlet-air flow rate GA.

$$PGS=PGB(NE,GN)/GA$$

At step 101, the second pressure correction factor σ is calculated as the function of the pressure ratio $K_{pa}$ which is the ratio of the atmospheric pressure, where the automobile operates, to the standard atmospheric pressure (760 mmHg).

$$\sigma=\sigma(K_{pa})$$

Figure 11:
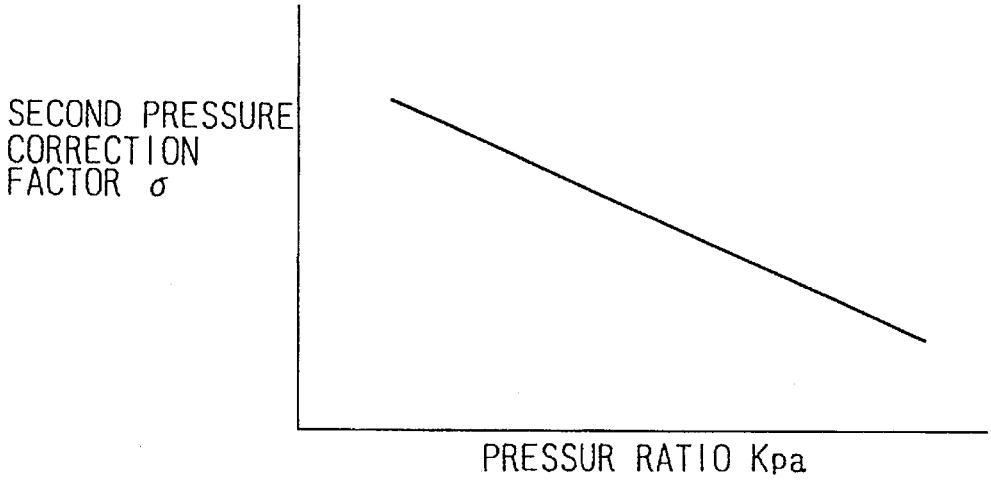
FIG. 11 is a graph to determine the second atmospheric pressure correction factor.

FIG. 11 is the graph to determine the second pressure correction factor σ, and the abscissa shows the pressure ratio $K_{pa}$, and the ordinate shows the second pressure correction factor σ. The second pressure correction factor σ is determined as the value which is inversely proportional to the pressure ratio $K_{pa}$.

At step 102, the corrected target purge rate PGRC is calculated by multiplying the target purge rate at standard atmospheric pressure PGR calculated at the purge rate calculating process shown in FIG. 4 and the second pressure correction factor σ.

At step 66, the duty ratio Duty is calculated from the following equation, and the control proceeds to step 67.

$$Duty=\gamma \cdot PGR/PGC+\delta$$

where γ and δ are the correction coefficients according to the battery voltage and the atmospheric pressure respectively.

At step 67, the duty ratio Duty is output, and this routine is terminated.

According to the third embodiment of the present invention, the opening of the purge valve is determined by the corrected target purge rate, that is, the target purge rate corrected by the atmospheric pressure where the automobile is operating.

Figure 12:
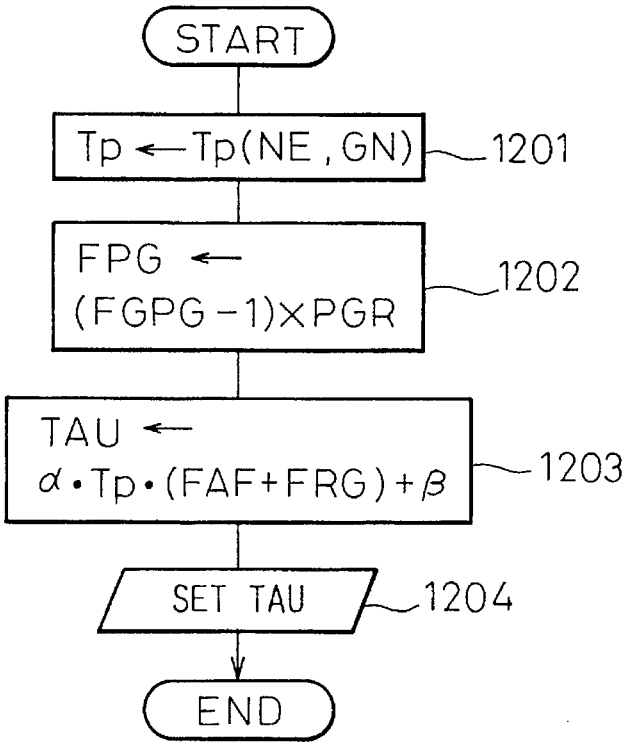
FIG. 12 is a flowchart of the purge valve driving routine.

FIG. 12 is the flowchart of the fuel injection valve control routine executed at every predetermined crank shaft angle.

At step 1201, the basic fuel injection valve opening interval Tp is calculated as the function of the engine speed NE and the inlet air flow rate per revolution GN.

$$Tp=Tp(NE,GN)$$

At step 1202, the purge correction factor FPG is calculated based on the vapor concentration index FGPG calculated in the vapor concentration learning routine discussed later and the purge rate PGR calculated in the purge rate control shown in FIG. 4.

$$FPG=(FGPG-1)\cdot PGR$$

At step 1203, the fuel injection valve opening interval TAU is calculated based on the air-fuel ratio correction factor FAF calculated in the air-fuel ratio control routine shown in FIG. 2 and the purge correction coefficient FPG according to the following equation.

$$TAU=\alpha \cdot Tp \cdot (FA+FPG)+\beta$$

Where, α and β are the correction coefficients based on the starting fuel increasing amount and the warming fuel increasing amount, etc.

At step 1204, the fuel injection valve opening interval TAU is output, and this routine is terminated.

Figure 13:
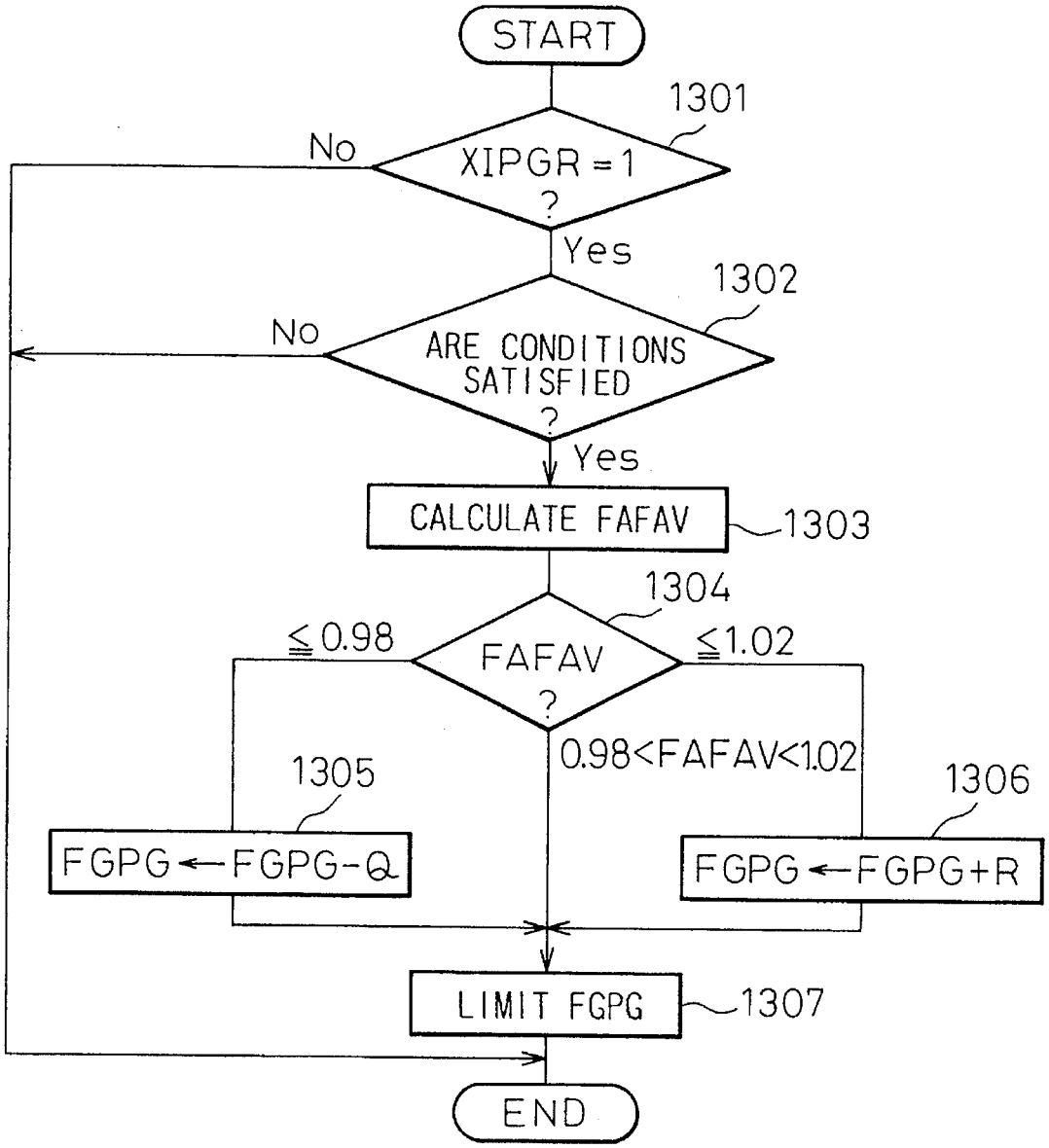
FIG. 13 is a flowchart of the fuel-vapor concentration learning routine.

FIG. 13 is the flowchart of the vapor concentration learning routine executed in the third invention.

At step 1301, it is determined whether or not the purge executing flag XPGON is "1", and if the determination is negative, this routine is directly terminated.

If the determination at step 1301 is affirmative, the control proceeds to step 1302, where it is determined whether or not the vapor concentration learning is allowable.

Namely, (1) The air-fuel ratio feedback control is being executed.

(2) The coolant temperature≧80° C.

(3) The starting fuel increase amount=0

(4) The warming fuel increase amount=0

When all above-mentioned conditions are satisfied, the vapor concentration learning is allowed. However, if any one of the above-mentioned conditions is not satisfied, it is not allowed.

If the determination at step 1302 is negative, that is, if the vapor concentration learning is not allowed, this routine is directly terminated.

If the determination at step 1302 is affirmative, that is, if the vapor concentration learning is allowed, the control proceeds to step 1303.

At step 1303, the moving average FAFAV of the air-fuel ratio correction factor FAF calculated in the air-fuel ratio control routine shown in FIG. 2 is calculated, and the control proceeds to step 1304.

At step 1304, it is determined to which range, that is "smaller than a predetermined lower level (for example, 0.98)", "larger than a predetermined the predetermined lower level and smaller than a predetermined upper level (for example, 1.02)" and "larger than the predetermined upper level", the moving average FAFAV belongs.

If the determination at step 1304 is that the moving average FAFAV is smaller than 0.98, the control proceeds to step 1305, where the vapor concentration index FGPG decreases the predetermined amount "Q" (for example 0.4%), and the control proceeds to step 1307.

If the determination at step 1304 is that the moving average FAFAV is larger than 1.02, the control proceeds to step 1306, where the vapor concentration index FGPG increases by the predetermined amount "P" (for example 0.4%), and the control proceeds to step 1307.

If the determination at step 1304 is that the moving average FAFAV is larger than 0.98 and smaller than 1.02, the control directly proceeds to step 1307 without renewing the vapor concentration index FGPG.

At step 1307, the vapor concentration index FGPG is limited to above the low limit value "0.7" and to below the upper limit value "1.0", and this routine is terminated.

Note, according to the above-mentioned process, the leaner the vapor-concentration, the closer to "1.0" the vapor-concentration index FGPG is set.

In the above-mentioned embodiment, the coordination between the real purge rate and the purge correction factor for the fuel injection amount is kept by setting the real purge rate as the target purge rate. But the coordination may be kept by reflecting the difference between the target purge rate and the real purge rate onto the purge correction factor for the fuel injection amount.

According to the present invention, the purge correction factor for the fuel injection amount in accordance with the real purge rate can always be determined, and the harmful influence on the drivability and/or the exhaust emission can be avoided.

We claim:

1. The method of disposing of fuel-vapor comprising the steps of:

detecting a driving condition of an engine;

calculating a standard opening of a purge valve, that is, an opening of a purge valve at standard atmospheric pressure in accordance with the driving condition detected at said detecting step;

calculating the basic fuel amount in order to control the air-fuel ratio of exhaust gas of the engine at a target air-fuel ratio determined in accordance with the driving condition detected at said detecting step;

calculating a correction factor for the basic fuel amount calculated at said basic fuel amount calculating step in accordance with the standard opening of the purge valve calculated at said standard opening of a purge valve calculating step;

detecting the atmospheric pressure;

correcting the standard opening of the purge valve calculated at said standard opening of a purge valve calculating step in accordance with the atmospheric pressure detected at said atmospheric pressure detecting step;

injecting fuel in an amount determined by the basic fuel amount calculated at said basic fuel amount calculating step; and driving the purge valve in accordance with the corrected standard opening of the purge valve corrected at said correcting step.

2. The method of disposing of fuel-vapor comprising the steps of:

detecting a driving condition of an engine;

calculating a standard opening of a purge valve, that is, an opening of a purge valve at standard atmospheric pressure in accordance with the driving condition detected at said detecting step;

calculating the basic fuel amount in order to control the air-fuel ratio of exhaust gas of the engine at a target air-fuel ratio determined in accordance with the driving condition detected at said detecting step;

calculating a correction factor for the basic fuel amount calculated at said basic fuel amount calculating step in accordance with the standard opening of the purge valve calculated at said standard opening of a purge valve calculating step;

detecting the atmospheric pressure;

correcting the correction factor for the fuel injection amount calculated at said correction factor calculating step in accordance with the atmospheric pressure detected at said atmospheric pressure detecting step;

injecting fuel in an amount determined by the basic fuel amount calculated at said basic fuel amount calculating step and the corrected correction factor corrected at said correcting step; and driving the purge valve in accordance with the standard opening of the purge valve calculated at said standard opening of a purge valve calculating step.

3. The method of disposing of the fuel-vapor comprising the steps of:

detecting a driving condition of an engine;

calculating a target purge rate in accordance with the driving condition detected at said driving condition detecting step;

calculating basic fuel amount in order to control the air-fuel ratio of exhaust gas of the engine at a target air-fuel ratio determined in accordance with the driving condition detected at said driving condition detecting step;

calculating the correction factor for the basic fuel amount calculated at said basic fuel amount calculating step in accordance with the target purge rate calculated at said target purge rate calculating step;

calculating a standard fully open purge rate, that is, the purge rate at the standard atmospheric pressure when the purge valve is fully opened in accordance with the driving condition detected at said driving condition detecting step;

detecting the atmospheric pressure;

correcting the standard fully open purge rate calculated at said standard fully open purge rate calculating step in accordance with the atmospheric pressure detected at said atmospheric pressure detecting step;

determining an opening of the purge valve in accordance with the target purge rate calculated at said target purge rate calculating step and the corrected standard fully open purge rate corrected at said standard fully open purge rate correcting step;

injecting fuel in an amount determined by the basic fuel amount calculated at said basic fuel amount calculating step and the correction factor corrected at said correction factor calculating step; and driving the purge valve in accordance with the opening of the purge valve determined at said opening of the purge valve determining step.

4. The method of disposing of the fuel-vapor comprising the steps of:

detecting a driving condition of an engine;

calculating a target purge rate in accordance with the driving condition detected at said detecting step;

calculating a basic fuel amount in order to control the air-fuel ratio of exhaust gas of the engine at a target air-fuel ratio determined in accordance with the driving condition detected at said detecting step;

calculating a correction factor for the basic fuel amount calculated at said fuel injection amount calculating step in accordance with the target purge rate calculated at said target purge rate calculating step;

detecting an atmospheric pressure;

calculating a fully open purge rate while operating based on the first fully open purge rate, that is, the purge rate when the purge valve is fully opened at the first predetermined atmospheric pressure, the second fully open purge rate, that is, the purge rate when the purge valve is fully opened at the second predetermined atmospheric pressure which is different from the first predetermined atmospheric pressure, and the atmospheric pressure detected by said atmospheric pressure detecting step;

determining the opening of the purge valve based on the target purge rate calculated at said target purge rate calculating step, and the fully open purge rate while operating calculated at said fully open purge rate at traveling calculating step;

injecting fuel in an amount determined by the basic fuel amount calculated at said basic fuel amount calculating step and the correction factor corrected at said correction factor calculating step; and driving the purge valve in accordance with the opening of the purge valve determined at said opening of the purge valve determining step.

5. The method of disposing of the fuel-vapor comprising the steps of:

detecting a driving condition of an engine;

calculating a target purge rate in accordance with the driving condition detected at said detecting step;

calculating a standard fully open purge rate, that is, the purge rate at the standard atmospheric pressure when the purge-valve is fully opened in accordance with the driving condition detected at said driving condition detecting step;

calculating a fuel injection amount in order to control the air-fuel ratio of exhaust gas of the engine at a target air-fuel ratio determined in accordance with the driving condition detected at said driving condition detecting step;

calculating a correction factor for the fuel injection amount calculated at said fuel injection amount calculating step in accordance with the target purge rate calculated at said target purge rate calculating step;

detecting an atmospheric pressure;

correcting the target purge rate calculated at said target purge rate calculating step in accordance with the atmospheric pressure detected at said atmospheric pressure detecting step;

determining the opening of the purge valve based on the corrected target purge rate corrected at said target purge rate correcting step and the standard fully open purge rate calculated at said standard fully open purge rate calculating step;

injecting fuel in an amount determined by the basic fuel amount calculated at said basic fuel amount calculating step and the corrected correction factor corrected at said correcting step; and driving the purge valve in accordance with the opening of the purge valve determined by said determining step.

6. The apparatus of disposing of the fuel-vapor comprising:

a charcoal canister for absorbing the fuel-vapor evaporating from a fuel tank of an engine;

a purge valve arranged in a purge pipe which connects said charcoal canister and an inlet pipe, and controls the flow rate of the purge gas;

a driving condition detecting means for detecting the driving condition of an engine;

a standard opening calculating means for calculating a standard opening of a purge valve, that is, an opening of a purge valve at standard atmospheric pressure in accordance with the driving condition detected by said driving condition detecting means;

a basic fuel amount calculating means for calculating basic fuel amount in order to control the air-fuel ratio of exhaust gas of the engine at a target air-fuel ratio determined in accordance with the driving condition detected by said driving condition detecting means;

a correction factor calculating means for calculating a correction factor for the basic fuel amount calculated by said basic fuel amount calculating means in accordance with the standard opening of the purge valve calculated by said standard opening calculating means;

an atmospheric pressure detecting means for detecting an atmospheric pressure;

a correcting means for correcting the standard opening of the purge valve calculated by said standard opening calculating means in accordance with the atmospheric pressure detected by said atmospheric pressure detecting means;

a fuel injecting means for injecting fuel in an amount determined by the basic fuel amount calculated by said basic fuel amount calculating means; and a purge valve driving means for driving the purge valve in accordance with the corrected standard opening of the purge valve corrected by said correcting means.

7. The apparatus of disposing of the fuel-vapor comprising:

a charcoal canister for absorbing the fuel-vapor evaporating from a fuel tank of an engine;

a purge valve arranged in a purge pipe which connects said charcoal canister and an inlet pipe, and controls the flow rate of the purge gas;

a driving condition detecting means for detecting the driving condition of an engine;

a standard opening calculating means for calculating a standard opening of a purge valve, that is, an opening of a purge valve at standard atmospheric pressure in accordance with the driving condition detected by said driving condition detecting means;

a basic fuel amount calculating means for calculating basic fuel amount in order to control the air-fuel ratio of exhaust gas of the engine at a target air-fuel ratio determined in accordance with the driving condition detected by said driving condition detecting means;

a correction factor calculating means for calculating a correction factor for the basic fuel amount calculated by said basic fuel amount calculating means in accordance with the standard opening of the purge valve calculated by said standard opening calculating means;

an atmospheric pressure detecting means for detecting an atmospheric pressure;

a correcting means for correcting the correction factor for the fuel injection amount calculating by said correction factor calculating means in accordance with the atmospheric pressure detected by said atmospheric pressure detecting means;

a fuel injecting means for injecting fuel in an amount determined by the basic fuel amount calculated by said basic fuel amount calculating means; and the correcting correction factor corrected by said correcting means; and a purge valve driving means for driving the purge valve in accordance with the standard opening of the purge valve calculated by said standard opening of the purge valve calculating means.

8. The apparatus of disposing of the fuel-vapor comprising:

a charcoal canister for absorbing the fuel-vapor evaporating from a fuel tank of an engine;

a purge valve arranged in a purge pipe which connects said charcoal canister and an inlet pipe, and controls the flow rate of the purge gas; a driving condition detecting means for detecting a driving condition of an engine;

a target purge rate calculating means for calculating a target purge rate in accordance with the driving condition detected by said driving condition detecting means;

a basic fuel amount calculating means for calculating the basic fuel amount in order to control the air-fuel ratio of exhaust gas of the engine at a target air-fuel ratio determined in accordance with the driving condition detected at said driving condition detecting means;

a correction factor calculating means for calculating the correction factor for the basic fuel amount calculated by said basic fuel amount calculating means in accordance with the target purge rate calculated by said target purge rate calculating means;

a standard fully open purge rate calculating means for calculating a standard fully open purge rate, that is, the purge rate at the standard atmospheric pressure when the purge valve is fully opened in accordance with the driving condition detected at said driving condition detecting means;

an atmospheric pressure detecting means for detecting an atmospheric pressure;

a correcting means for correcting the standard fully open purge rate calculated by said standard fully open purge rate calculating means in accordance with the atmospheric pressure detected by said atmospheric pressure detecting means;

a determining means for determining an opening of the purge valve in accordance with the target purge rate calculated by said target purge rate calculating means and the corrected standard fully open purge rate corrected by said standard fully open purge rate correcting means;

a fuel injecting means for injecting fuel in an amount determined by the basic fuel amount calculated by said basic fuel amount calculating means and the correction factor calculated by said correction factor calculating means; and a purge valve driving means for driving the purge valve in accordance with the opening of the purge valve determined at said determining means.

9. The apparatus of disposing of the fuel-vapor comprising:

a charcoal canister for absorbing the fuel-vapor evaporating from a fuel tank of an engine;

a purge valve arranged in a purge pipe which connects said charcoal canister and an inlet pipe, and controls the flow rate of the purge gas;

a driving condition detecting means for detecting a driving condition of an engine;

a target purge rate calculating means for calculating a target purge rate in accordance with the driving condition detected at said driving condition detecting means;

a basic fuel amount calculating means for calculating a basic fuel amount in order to control the air-fuel ratio of exhaust gas of the engine at a target air-fuel ratio determined in accordance with the driving condition detected at said detecting means;

a correction factor calculating means for calculating a correction factor for the basic fuel amount calculated at said fuel injection amount calculating means in accordance with the target purge rate calculated at said target purge rate calculating means;

an atmospheric pressure detecting for detecting an atmospheric pressure;

a fully open purge rate calculating means for calculating a fully open purge rate while operating based on the first fully open purge rate, that is, the purge rate when the purge valve is fully opened at the first predetermined atmospheric pressure, the second fully open purge rate, that is, the purge rate when the purge valve is fully opened at the second predetermined atmospheric pressure which is different from the first predetermined atmospheric pressure, and the atmospheric pressure detected by said atmospheric pressure detecting means;

a determining means for determining the opening of the purge valve based on the target purge rate calculated at said target purge rate calculating means, and the fully open purge rate at traveling calculated at said fully open purge rate calculating means;

a fuel injecting means for injecting fuel in an amount determined by the basic fuel amount calculated by said basic fuel amount calculating means and the correction factor corrected by said correction factor calculating means; and a purge valve driving means for driving the purge valve in accordance with the opening of the purge valve determined by said opening of the purge valve determining means.

10. The apparatus of disposing of the fuel-vapor comprising:

a charcoal canister for absorbing the fuel-vapor evaporating from a fuel tank of an engine;

a purge valve arranged in a purge pipe which connects said charcoal canister and an inlet pipe, and controls the flow rate of the purge gas;

a driving condition detecting means for detecting a driving condition of an engine;

a target purge rate calculating means for calculating a target purge rate in accordance with the driving condition detected at said detecting means;

a standard fully open purge rate calculating means for calculating a standard fully open purge rate, that is, the purge rate at the standard atmospheric pressure when the purge-valve is fully opened in accordance with the driving condition detected by said driving condition detecting means;

a basic fuel amount calculating means for calculating a basic fuel amount in order to control the air-fuel ratio of exhaust gas of the engine by a target air-fuel ratio determined in accordance with the driving condition detected by said driving condition detecting means;

a correction factor calculating means for calculating a correction factor for the fuel injection amount calculated by said basic fuel amount calculating means in accordance with the target purge rate calculated by said target purge rate calculating means;

an atmospheric pressure detecting means for detecting an atmospheric pressure;

a correcting means for correcting the target purge rate calculated by said target purge rate calculating means in accordance with the atmospheric pressure detected by said atmospheric pressure detecting means;

a determining means for determining the opening of the purge valve based on the corrected target purge rate corrected by said target purge rate correcting means and the standard fully open purge rate calculated by said standard fully open purge rate calculating means;

a fuel injecting means for injecting fuel in an amount determined by the basic fuel amount calculated by said basic fuel amount calculating means and the correction factor calculated by said correcting step; and a purge valve driving means for driving the purge valve in accordance with the opening of the purge valve determined by said determining means.

* * * * *

UNITED STATES PATENT AND TRADEMARK OFFICE

CERTIFICATE OF CORRECTION

PATENT NO. : 5,558,072

DATED : September 24, 1996

INVENTOR(S) : Kenji HARIMA, et al.

It is certified that error appears in the above-indentified patent and that said Letters Patent is hereby corrected as shown below: Title page, item [57], ABSTRACT, line 1, change "though" to --through--.

Column 2, line 51, delete the comma after "13".

Column 3, line 17, insert --the-- between "of" and "fuel".

Column 3, line 23, delete "the".

Column 4, line 32, delete the comma after "the" before "flowchart".

Column 5, line 47, change "are" to --is--.

Column 6, line 19, change "equations," to --equation,--.

Column 7, line 8, change "where" to --Where--.

Column 8, line 7, delete "the predetermined" after "a predetermine".

Column 9, line 39, insert --the-- between "calculating" and "basic".

Column 11, line 24, insert --a-- before "basic".

UNITED STATES PATENT AND TRADEMARK OFFICE

CERTIFICATE OF CORRECTION

PATENT NO. : 5,558,072

DATED : September 24, 1996

INVENTOR(S) : Kenji HARIMA, et al.

It is certified that error appears in the above-indentified patent and that said Letters Patent is hereby corrected as shown below:

Column 11, line 63, insert --a-- before "basic".

Column 12, line 28, "a driving condition..." should start a new paragraph.

Column 13, line 31, between "detecting" and "for" insert --means--.

Signed and Sealed this

Third Day of June, 1997

*Attest:*

Bruce Lehman

BRUCE LEHMAN

*Attesting Officer*

*Commissioner of Patents and Trademarks*